US005515548A

United States Patent [19]

Lazarus

[11] Patent Number: 5,515,548

[45] Date of Patent: May 14, 1996

[54] SPORTS GLOVE WITH ASYMMETRICAL THUMB SEAM PATTERN

[76] Inventor: Alan H. Lazarus, 31 Carpenters Ridge, Cincinnati, Ohio

[21] Appl. No.: 236,119

[22] Filed: May 2, 1994

[51] Int. Cl.[6] ..... A41D 19/02

[52] U.S. Cl. ..... 2/169; 2/161.2

[58] Field of Search ..... 2/161.2, 161.1, 2/159, 163, 169

[56] References Cited

U.S. PATENT DOCUMENTS

| | | | |
|---|---|---|---|
| 144,665 | 11/1873 | Foster | 2/169 |
| 666,853 | 1/1901 | Morgan | 2/169 |
| 692,224 | 2/1902 | Baird | 2/169 |
| 975,289 | 11/1910 | Sachs | 2/169 |
| 1,252,900 | 1/1918 | Grinnell | 2/169 |
| 4,858,245 | 8/1989 | Sullivan et al. | 2/169 |
| 5,175,886 | 1/1993 | Suk | 2/161.2 |

*Primary Examiner*—Michael A. Neas
*Attorney, Agent, or Firm*—John M. Brandt

[57] ABSTRACT

A sport glove thumb portion wherein the joining seam is asymmetrical and located above the tip and on the back of the thumb. A pattern and seam arrangement are also disclosed.

2 Claims, 1 Drawing Sheet

SPORTS GLOVE WITH ASYMMETRICAL THUMB SEAM PATTERN

FIELD OF THE INVENTION

The invention resides in the field of sports gloves and more particularly relates to thumb seam location in a gripping glove such as a golf glove.

BACKGROUND OF THE INVENTION

Typically, gripping gloves for securely holding sports implements such as golf clubs are made of leather or leatherlike material and are designed to fit very snugly and conform perfectly to the shape of the wearer's hand. The intent is to create a second skin wherein the grip on the sports implement for example, a golf club, is substantially improved without interfering with the natural action of the user.

Thumbs for such gloves have heretofore been cut from one piece of material in a symmetrical shape known as the Bolton pattern. In the finished product, the seam joining the two sides of the thumb portion is positioned at the tip of the thumb and thumbnail.

As this is a contact point in the employment of a proper grip, particularly in the handling of golf clubs, this tip of the thumb seam position in prior art gloves can interfere with an optimum contact creating an annoyance in the wearer.

The present invention is directed to the repositioning of the seam from the tip and side of tile thumb to the back of the thumbnail to eliminate this undesirable contact interference and thereby improve the performance of the user.

SUMMARY OF THE INVENTION

The invention may be summarized as an improvement in a sports glove, in which the thumb seam is positioned over the back of the thumbnail rather than the tip and side of the thumb as is the present case. This is accomplished utilizing a thumb pattern which is asymmetrical rather than symmetrical having a central palm portion and two opposed wing portions attached thereto.

The palm portion is the shape of a full thumb including the sides and the wing portions are each the shape of a half of a back of a thumb and are sized such that when folded over and joined to each other with a central lateral seam and joined to the palm portion by a cross seam, the relocation of the thumb seam to the back of the thumbnail is achieved.

In use the point of thumb contact in a standard golf club grip is therefore covered by just the material of which the glove is fabricated and is essentially seam free.

These and other features and advantages of the invention will be more fully understood from the description of the preferred embodiment and drawings which follows.

DESCRIPTION OF THE PREFERRED EMBODIMENT

Figure 1:
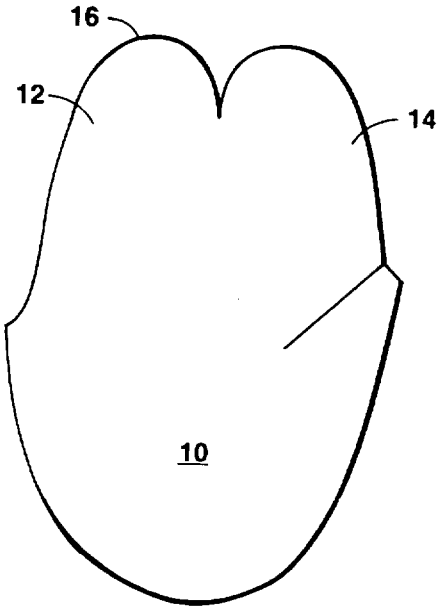
FIGURE 1 PRIOR ART
FIG. 1 is a plan view of a glove thumb pattern of the prior art.
Figure 3:
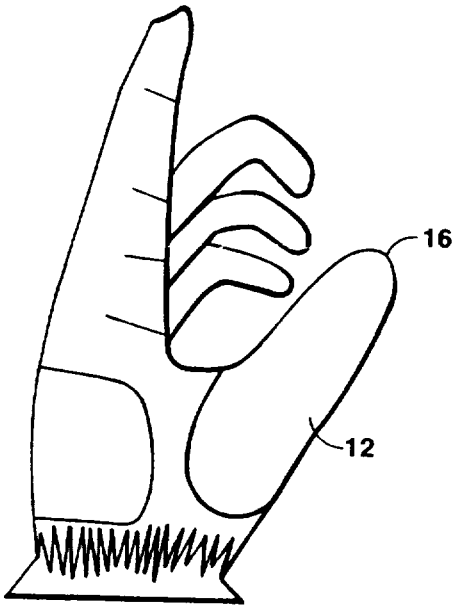
FIGURE 3 PRIOR ART
FIG. 3 is a plan view of the completed thumb of the pattern of FIG. 1.

Referring first to FIG. 1 there is shown a plan view of a glove thumb pattern of the prior art known as the Bolton pattern. Pattern 10, comprised of any suitable material for example, fabric or leather, is composed of two essentially symmetrical portions 12 and 14. In the fabrication of the glove, the pattern is folded over and sewn along line 16 forming a seam as is showing in FIG. 3 which rests atop the thumb of the user. It will be understood that in the nomenclature of glove manufacturing the direction known as above is that away from the fingers and toward the wrist.

Figure 2:
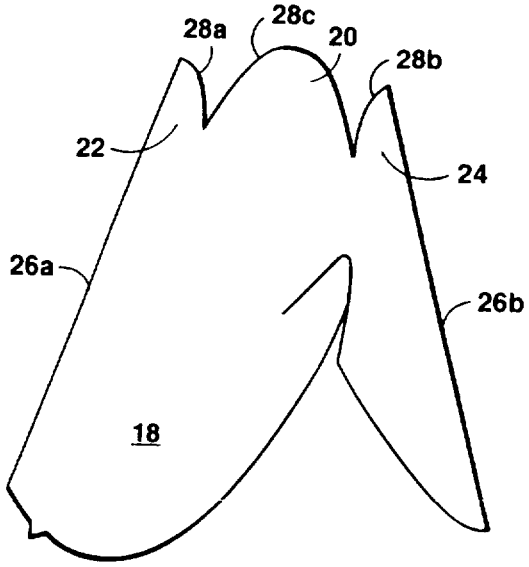
FIG. 2 is a plan view of the glove thumb pattern of the preferred embodiment of the invention.

FIG. 2 illustrates the pattern used to construct the thumb of the preferred embodiment of the invention. Pattern 18 consists of a central palm portion 20 which is of sufficient size to wrap around and form the sides of the thumb. Two opposed wing portions 22 and 24 are attached to and integral with central portion 20 and are of sufficient size to each form one half the back of the thumb.

Figure 4:
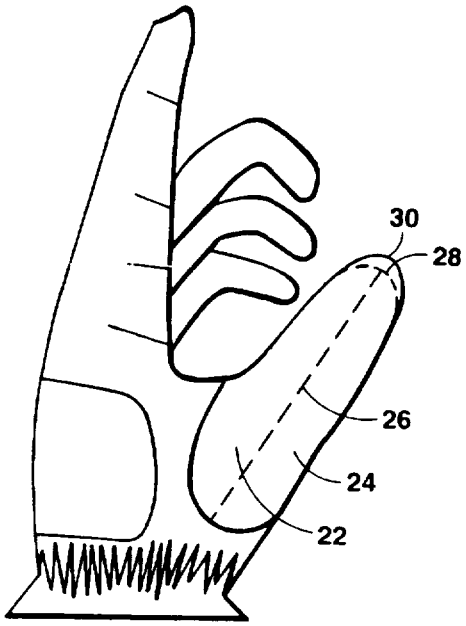
FIG. 4 is a plan view of the completed thumb of the pattern of FIG. 2.

Two separate stitches or seams are used to secure the above portions into a finished thumb. One is a lateral seam formed by attaching edges 26*a* and 26*b* and the other is a cross seam formed by attaching edges 28*a*, 28*b* and 28*c*. The resulting construction is shown in FIG. 4 where like numbers refer to like components of FIG. 2. As will be seen, seam 28 is above the apex 30 of the thumb on the hand of the user and rests on the back of the thumbnail rather than the tip as has heretofore been explained.

As variations in the above described construction might be made in order to obtain the same resulting configuration the invention is hereby defined by the following claims.

What is claimed is:

1. A glove including a thumb unit comprised of:

A. a pattern comprised of:

1. a central palm portion arranged to cover the palm and two sides of said thumb when said pattern is sewn into a completed unit; and
2. two adjacent wing portions attached to each side of said palm portion each arranged to cover one half the back of said thumb when said pattern is sewn into a completed unit, said unit formed by joining the side edges of said wing portions with a lateral seam and the top edges of said palm portion and said wing portion with a cross seam, said cross seam arranged to lie within that part of said back which when in use will cover the thumbnail of the wearer.

2. The thumb unit of claim 1 wherein said cross seam follows the curvature of the tip of said thumb.

* * * * *